US012584682B2

(12) United States Patent
Lee et al.

(10) Patent No.: US 12,584,682 B2
(45) Date of Patent: Mar. 24, 2026

(54) REFRIGERATOR

(71) Applicant: LG ELECTRONICS INC., Seoul (KR)

(72) Inventors: Donghoon Lee, Seoul (KR); Wookyong Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 213 days.

(21) Appl. No.: 18/287,921

(22) PCT Filed: May 27, 2022

(86) PCT No.: PCT/KR2022/007596

§ 371 (c)(1),
(2) Date: Oct. 23, 2023

(87) PCT Pub. No.: WO2022/255743

PCT Pub. Date: Dec. 8, 2022

(65) Prior Publication Data

US 2024/0200856 A1 Jun. 20, 2024

(30) Foreign Application Priority Data

Jun. 4, 2021 (KR) ..... 10-2021-0072900

(51) Int. Cl.
*F25D 23/06* (2006.01)

(52) U.S. Cl.
CPC ..... *F25D 23/065* (2013.01); *F25D 2201/10* (2013.01)

(58) Field of Classification Search
CPC .. F25D 23/065; F25D 23/025; F25D 2323/06; F25D 2500/02
See application file for complete search history.

(56) References Cited

U.S. PATENT DOCUMENTS 2,942,438 A * 6/1960 Schmeling ..... F25D 23/04 62/377
2,945,733 A * 7/1960 Malia ..... F25D 23/04 312/283

(Continued)

FOREIGN PATENT DOCUMENTS

KR 10-2002-0018368 3/2002
KR 10-0565622 3/2006

(Continued)

OTHER PUBLICATIONS

International Search Report dated Sep. 20, 2022 issued in Application No. PCT/KR2022/007596.

*Primary Examiner* — Daniel J Rohrhoff
(74) *Attorney, Agent, or Firm* — KED & ASSOCIATES, LLP

(57) ABSTRACT

A refrigerator according to the present disclosure may include a first insulation wall having a first storage space: a second insulation wall configured to be arranged in a first direction together with the first insulation wall and having a second storage space maintained at a different temperature from the first storage space, and configured to open and close the first storage space: and a door configured to be arranged in the first direction together with the second insulation wall and to open and close the second storage space.

16 Claims, 14 Drawing Sheets

(56) References Cited

U.S. PATENT DOCUMENTS

| | | | | |
|---|---|---|---|---|
| 3,086,830 | A * | 4/1963 | Malia | F25D 23/04 62/448 |
| 9,091,476 | B2 * | 7/2015 | Kim | F25D 23/02 |
| 9,696,084 | B1 * | 7/2017 | Kalva | F25D 23/025 |
| 11,215,391 | B1 * | 1/2022 | Hanson | F25D 23/028 |
| 2015/0233629 | A1 * | 8/2015 | Choi | F25D 23/04 312/405 |
| 2016/0040467 | A1 * | 2/2016 | Hwang | F16B 1/00 312/405 |
| 2020/0096245 | A1 * | 3/2020 | Besore | F25D 23/028 |
| 2021/0080167 | A1 * | 3/2021 | Kim | F25D 23/025 |
| 2023/0332823 | A1 * | 10/2023 | Kwon | F25D 23/028 |
| 2024/0044567 | A1 * | 2/2024 | Lee | F25D 17/065 |
| 2024/0077249 | A1 * | 3/2024 | Jeong | F25D 23/025 |

FOREIGN PATENT DOCUMENTS

| | | |
|---|---|---|
| KR | 10-2011-0085099 | 7/2011 |
| KR | 10-2012-0063316 | 6/2012 |
| KR | 10-2017-0060318 | 6/2017 |

* cited by examiner

【Fig. 1】
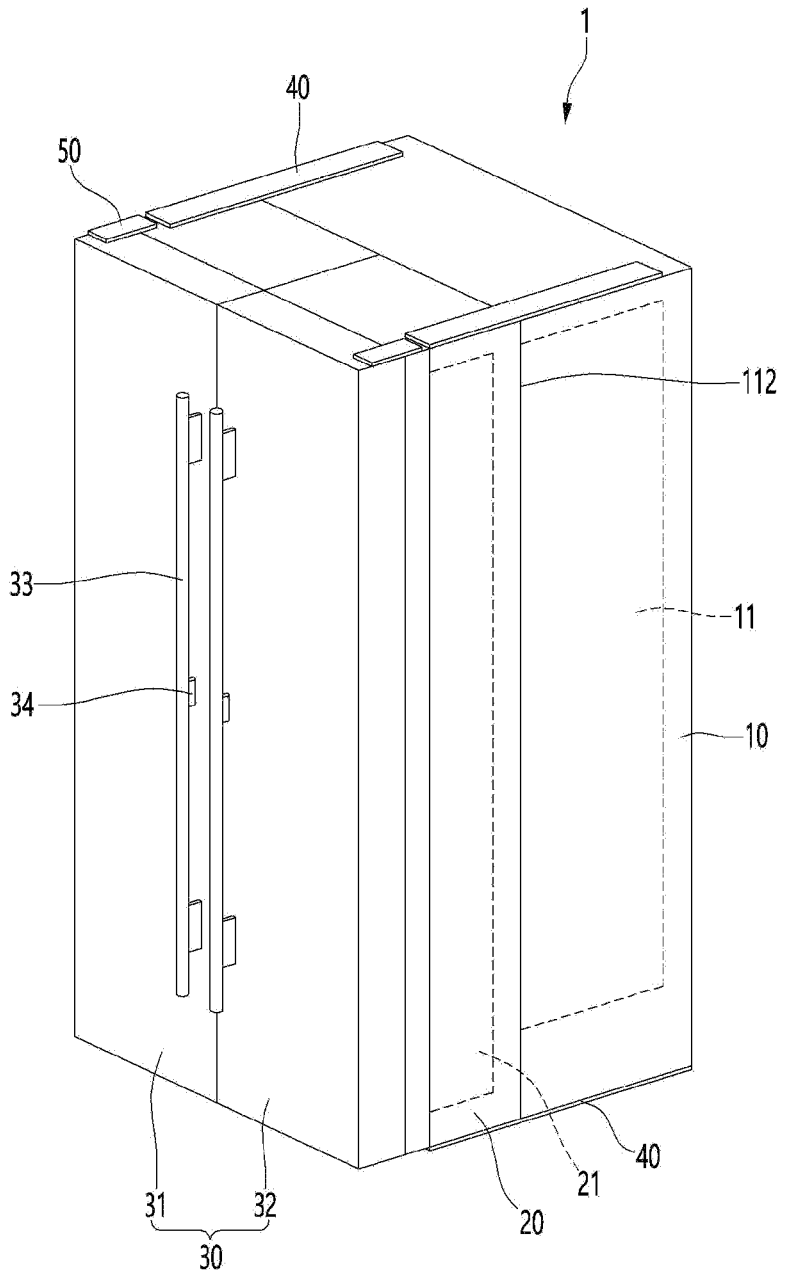

【Fig. 2】
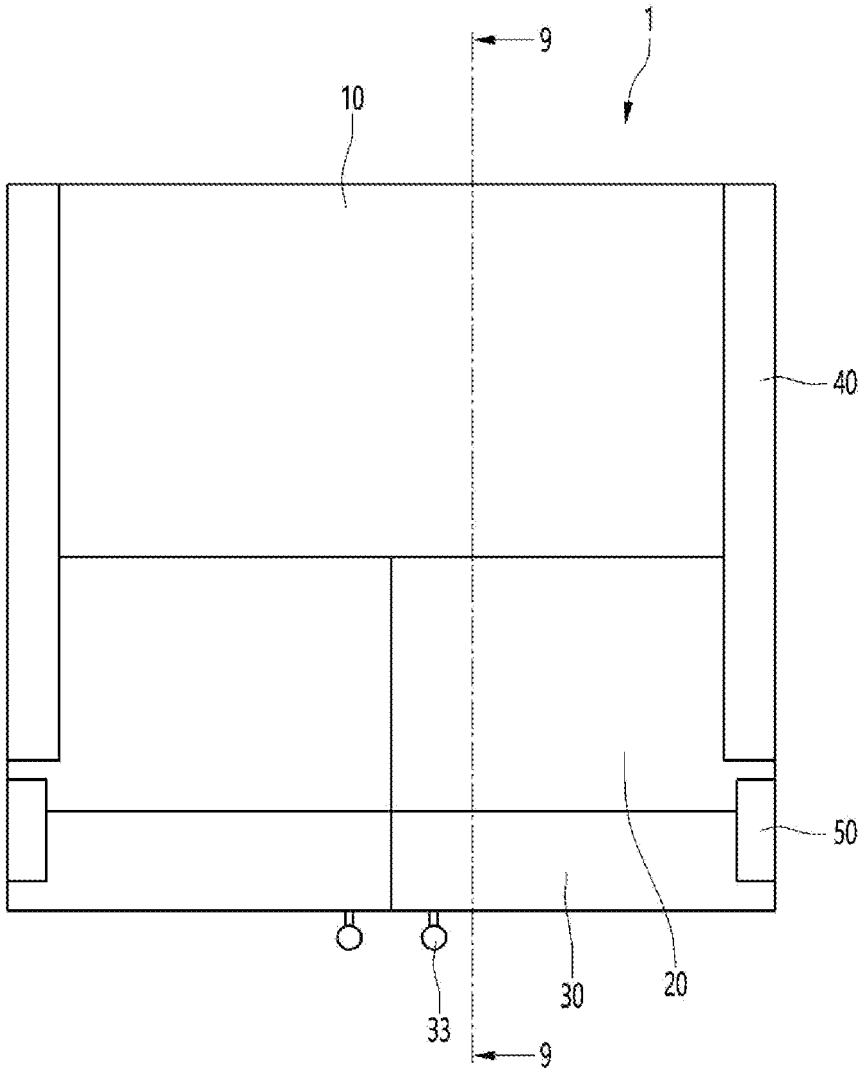

【Fig. 3】
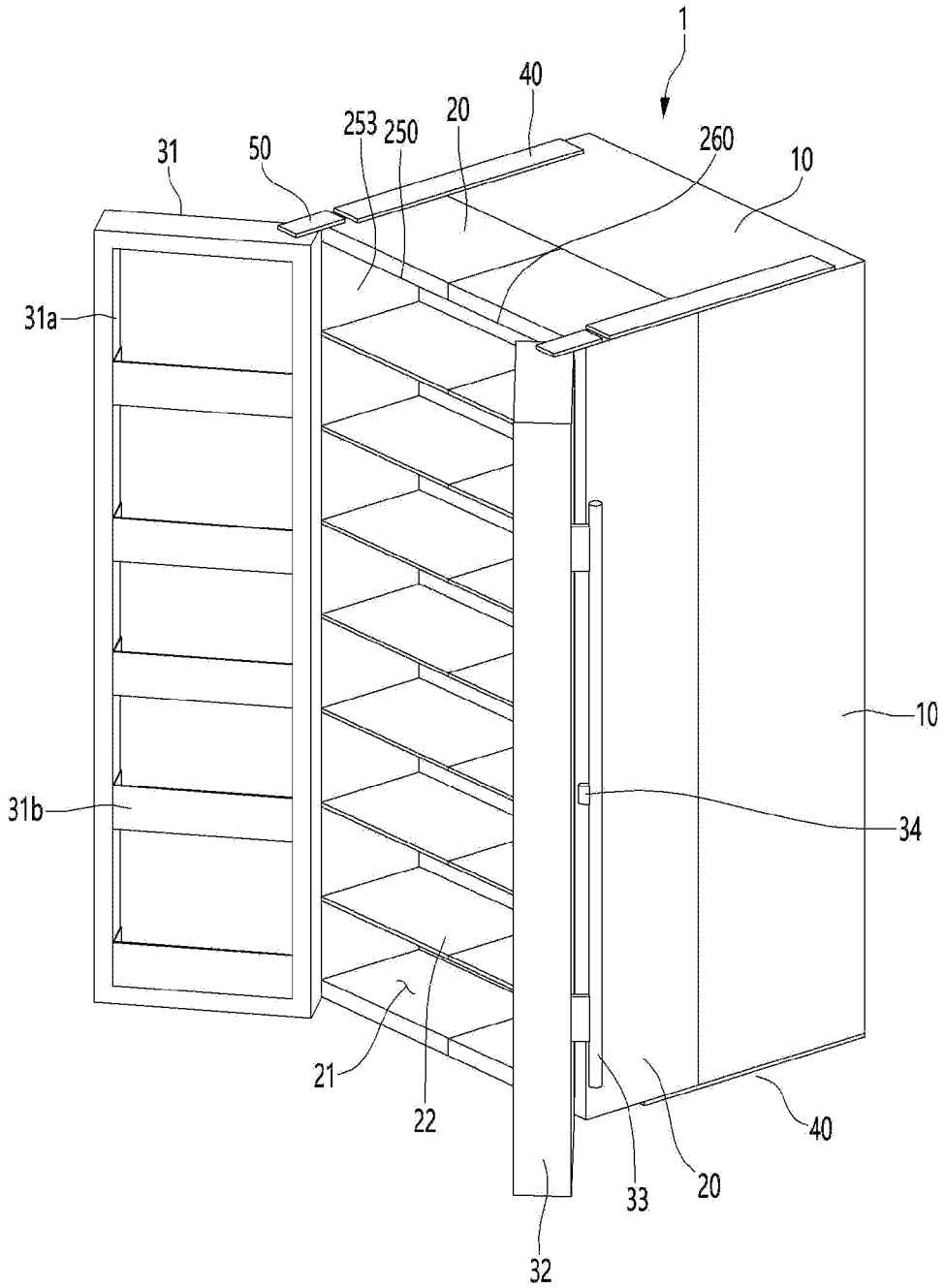

【Fig. 4】
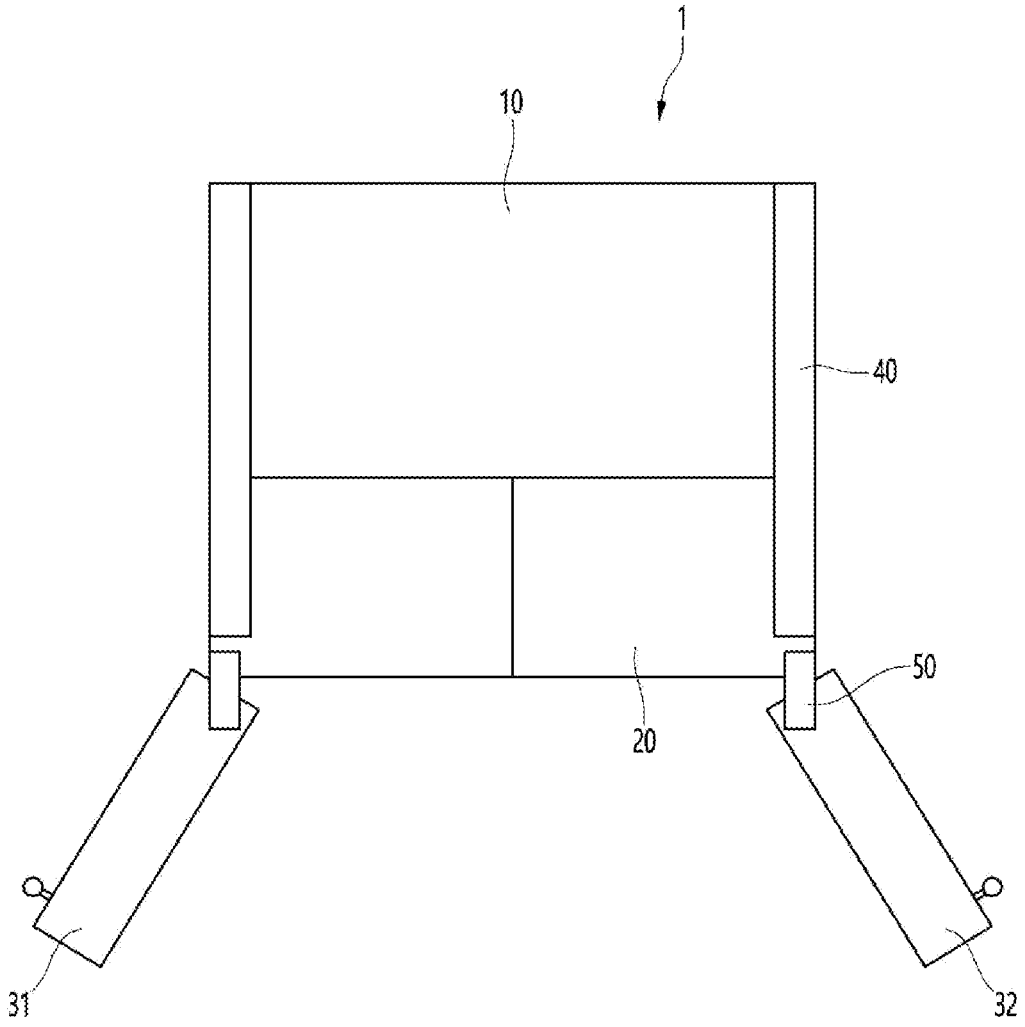

【Fig. 5】
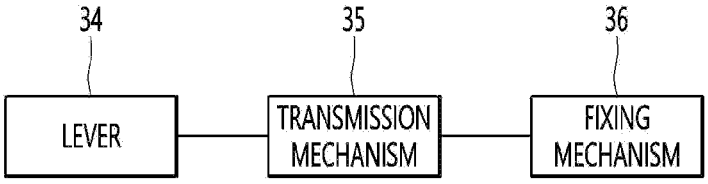

【Fig. 6】
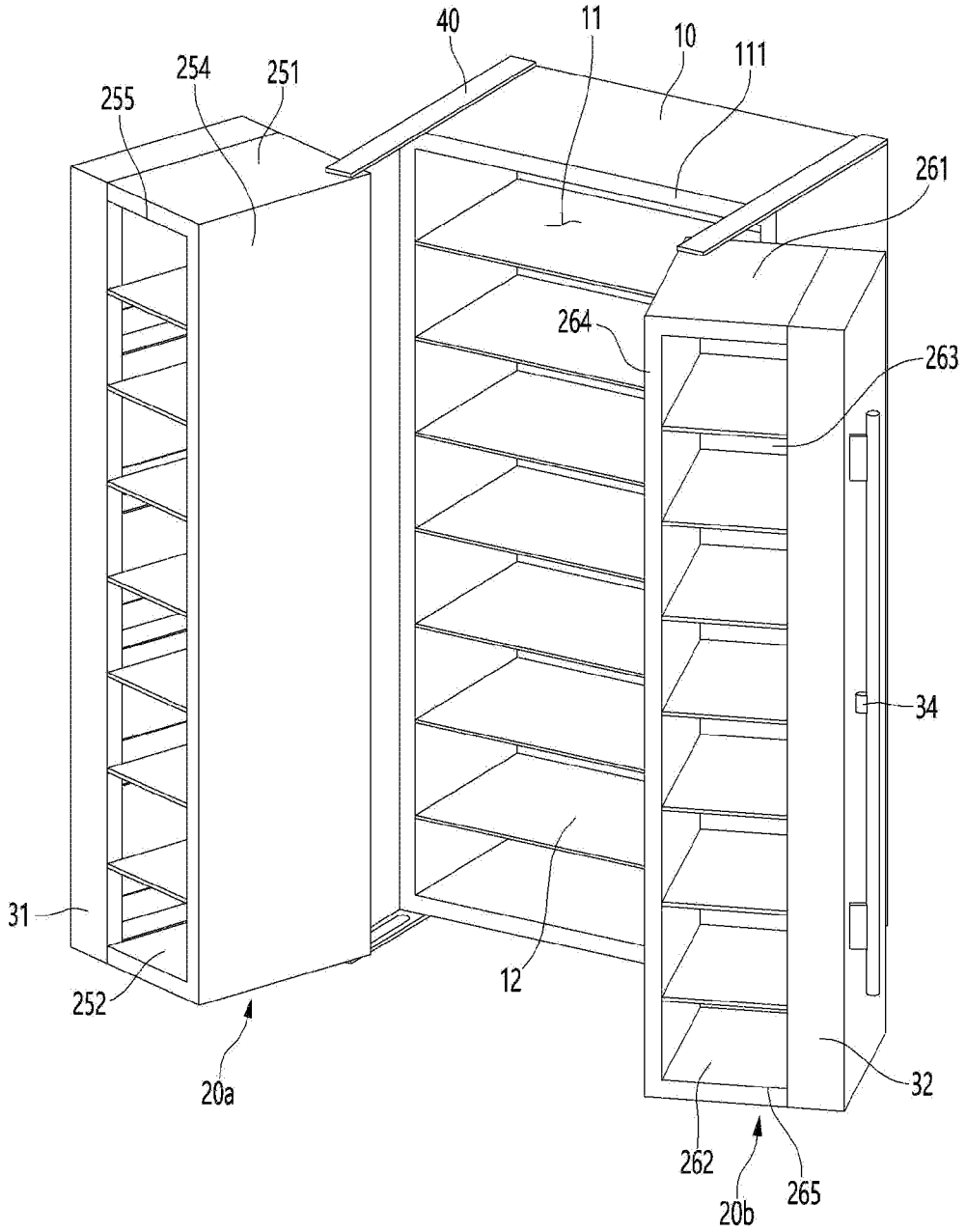

【Fig. 7】
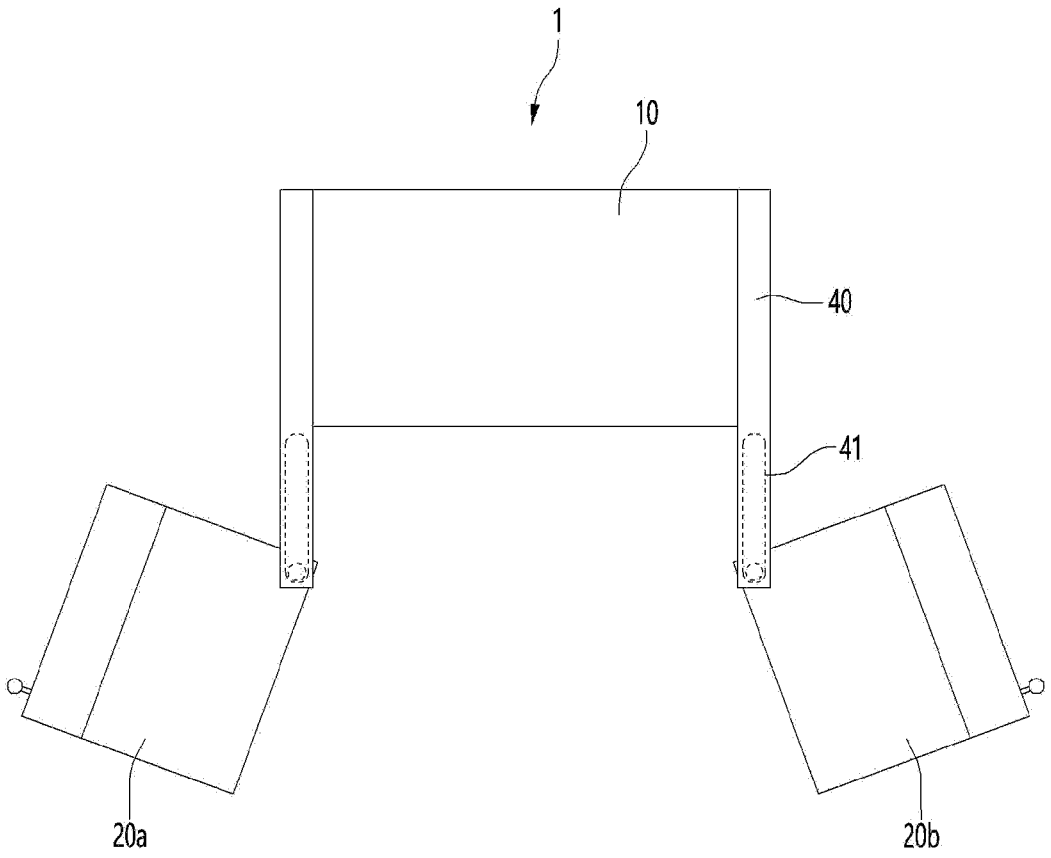

【Fig. 8】
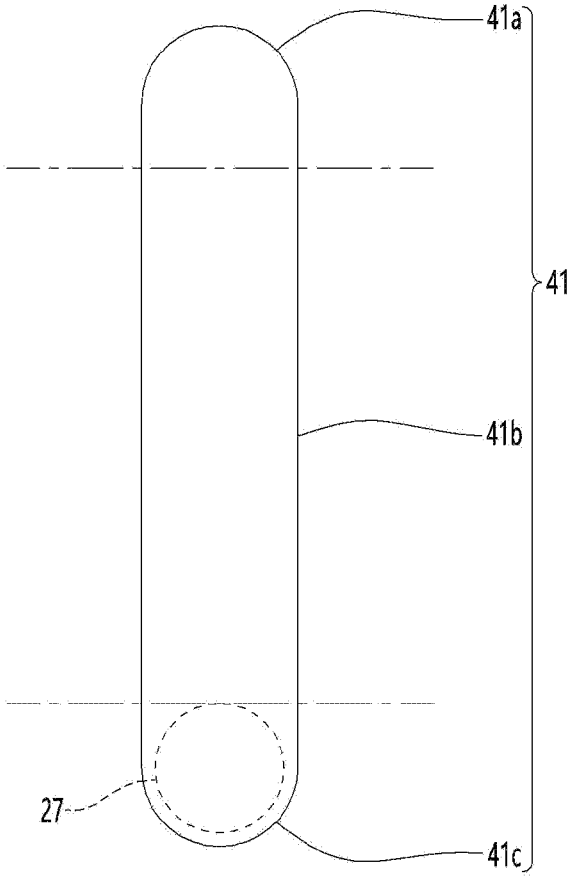

【Fig. 9】
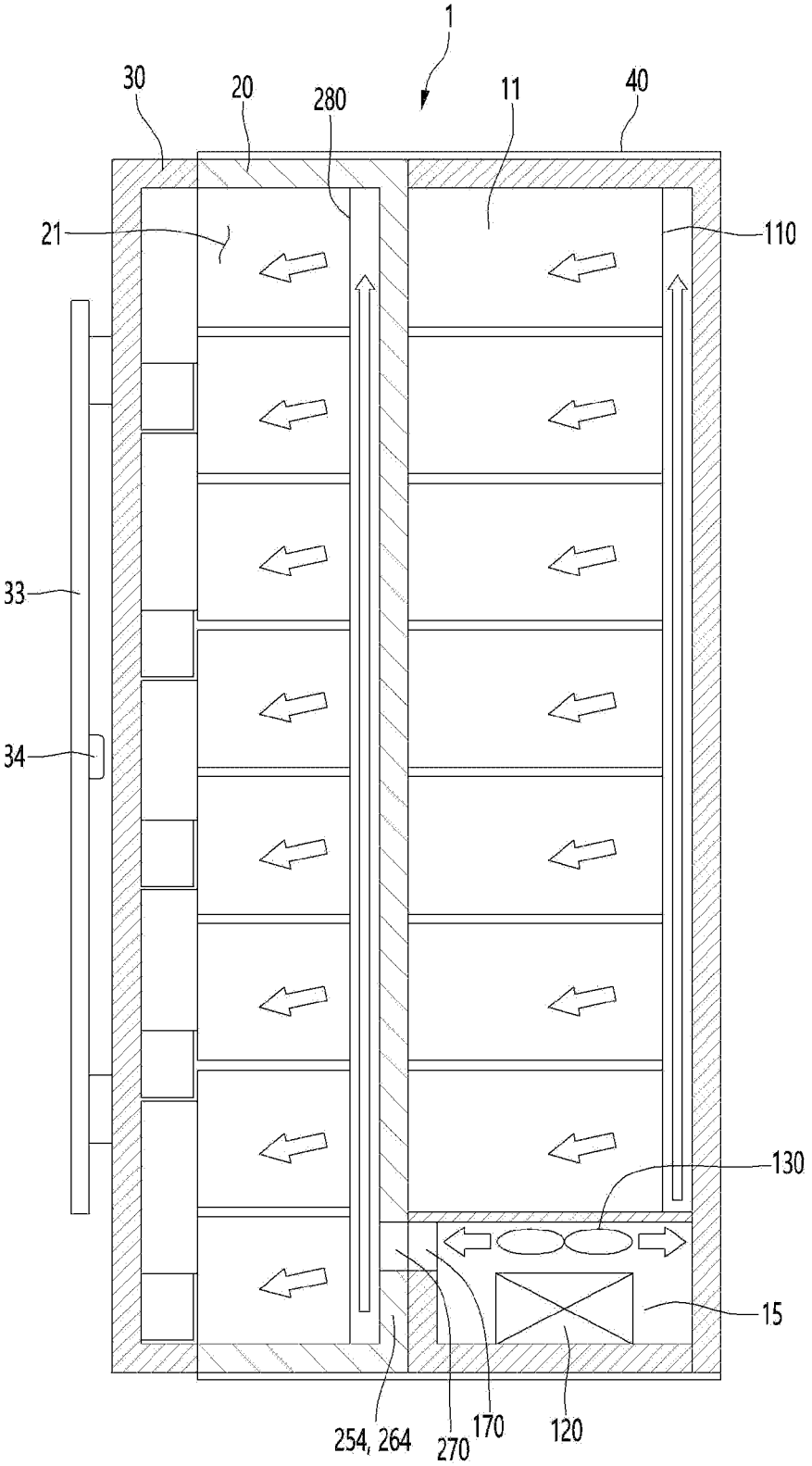

【Fig. 10】
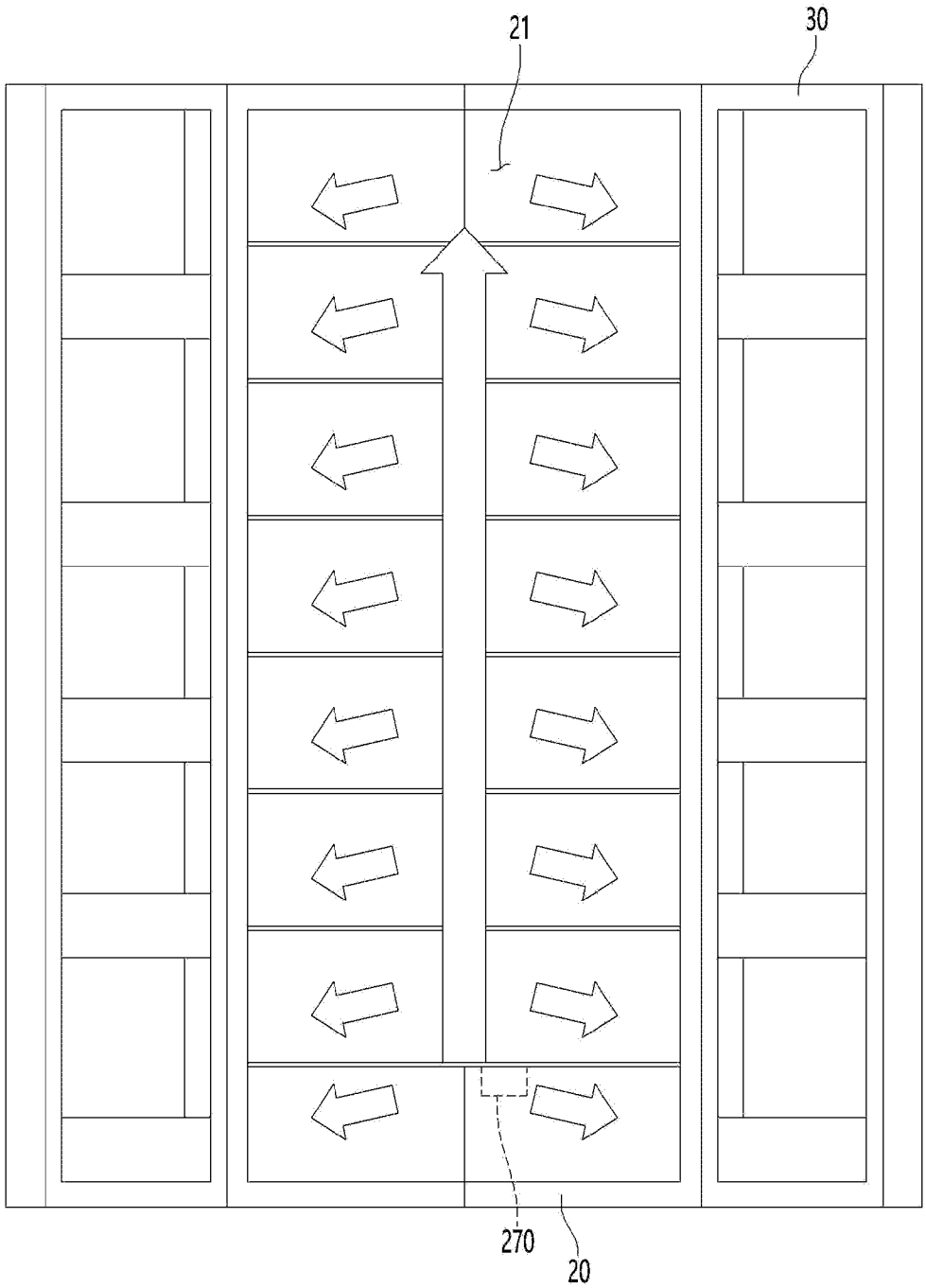

【Fig. 11】
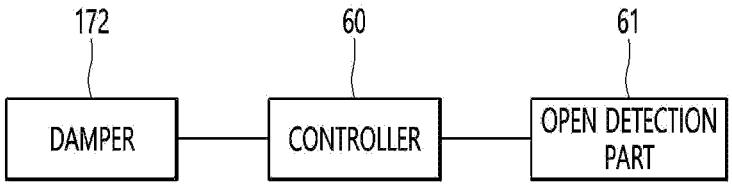

【Fig. 12】
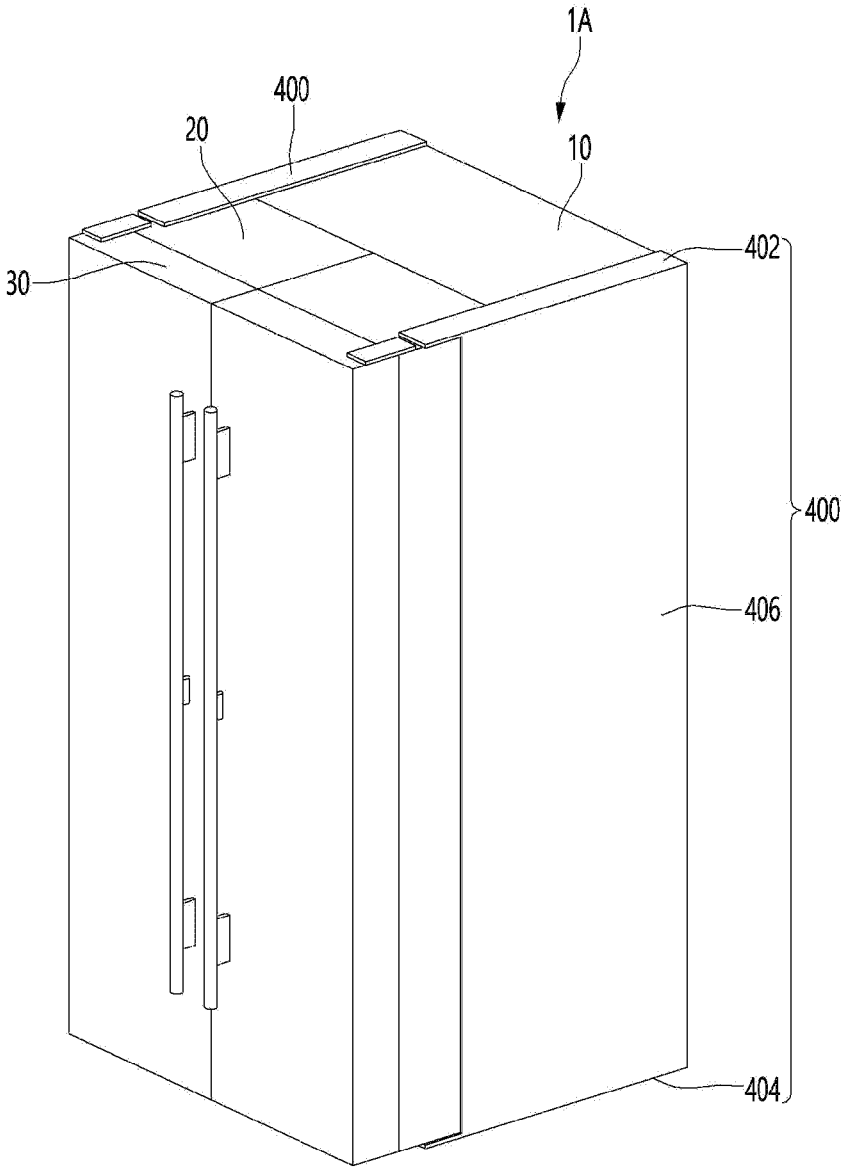

【Fig. 13】
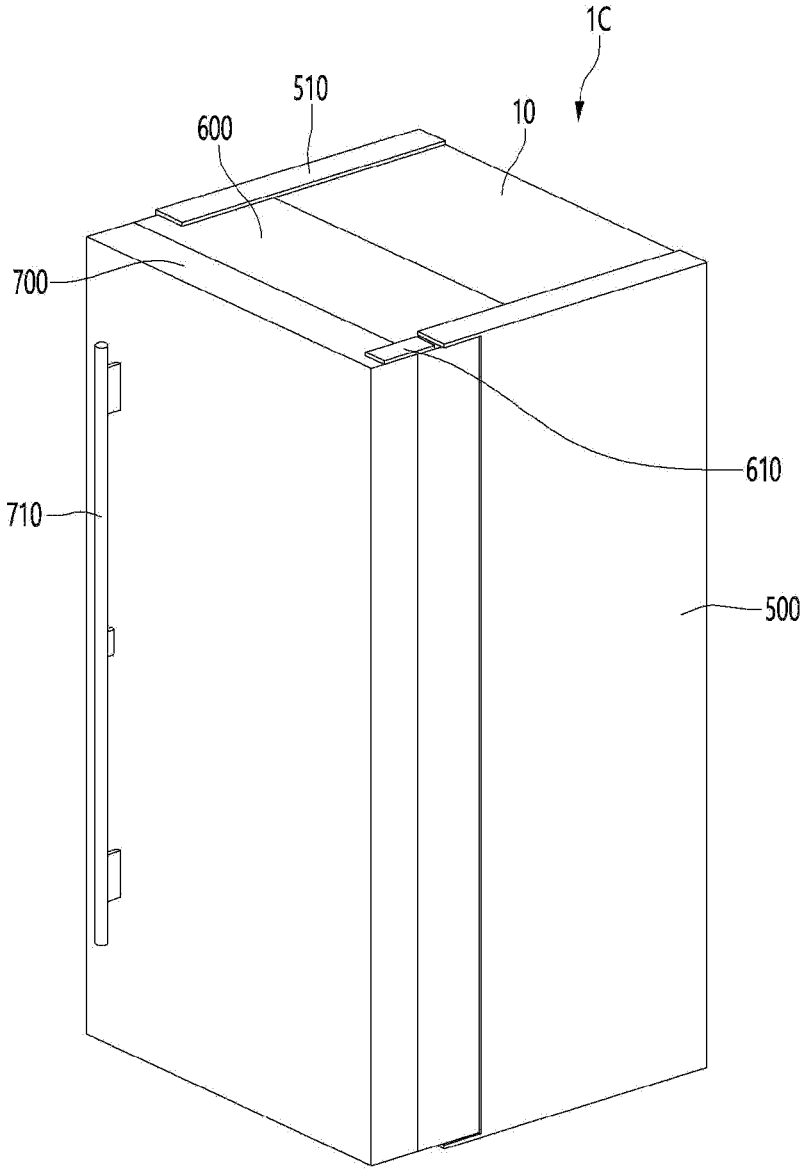

【Fig. 14】
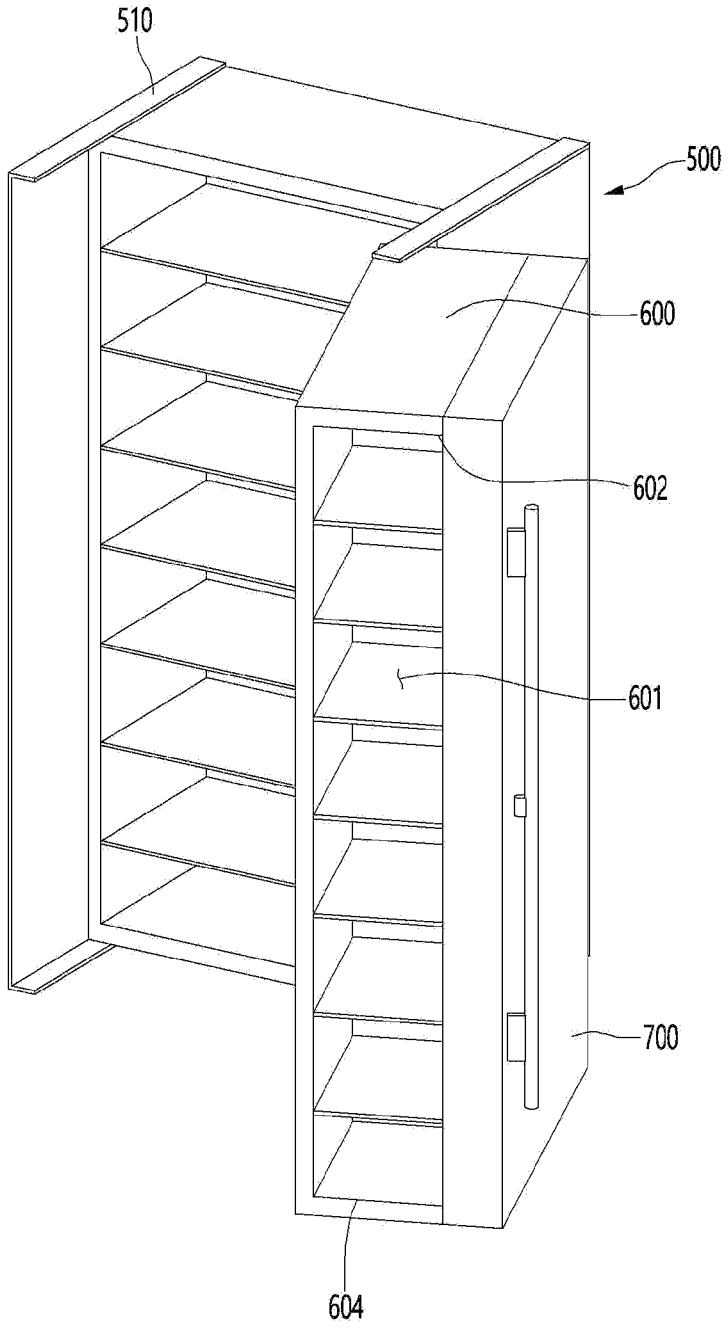

REFRIGERATOR

CROSS-REFERENCE TO RELATED PATENT APPLICATIONS

This application is a U.S. National Stage Application under 35 U.S.C. § 371 of PCT Application No. PCT/KR2022/007596, filed May 27, 2022, which claims priority to Korean Patent Application No. 10-2021-0072900, filed Jun. 4, 2021, whose entire disclosures are hereby incorporated by reference.

TECHNICAL FIELD

This specification relates to a refrigerator.

BACKGROUND ART

In general, a refrigerator is a home appliance that can store food at a low temperature in an internal storage space that is shielded by a refrigerator door and is configured to store the stored food in an optimal state by cooling the inside of the storage space using cold air generated through heat exchange with the refrigerant circulating in the refrigeration cycle.

As an example of the refrigerator, there is a top mount type refrigerator in which a freezing chamber is located at an upper side and a refrigerating chamber is located at a lower side and a bottom freezer type refrigerator in which a refrigerating chamber is located at an upper side and a freezing chamber is located at a lower side. However, in these two types of refrigerators, the storage space located at the upper side can be used without bending the user's waist, but the storage space located at the lower side has a disadvantage in that the user must bend the waist to access the storage space.

Meanwhile, Korean Patent Laid-Open Publication No. 10-2011-0085099, which is a prior document, discloses the above two types of refrigerators and another type of side-by-side type refrigerator.

In the side-by-side type refrigerator, the freezing chamber may extend in a vertical direction, and the refrigerating chamber may extend in the vertical direction on the right side of the freezing chamber. Accordingly, when the user places frequently used food on the upper side of each storage space, the user can access the upper side of the storage space without bending his or her back.

However, the side-by-side type refrigerator has a limitation in that the width of each storage space is limited, and thus food having a long width cannot be stored in the storage space.

DISCLOSURE OF INVENTION

Technical Problem

The present embodiment provides a refrigerator capable of storing food with a long width since the left and right widths of each divided storage space can be increased.

Optionally or additionally, the present embodiment provides a refrigerator in which each divided storage space may include an upper space and a lower space.

Optionally or additionally, the present embodiment provides a refrigerator in which a user can easily store or withdraw food in the storage space by reducing a distance from the opening to the rear wall of each storage space.

Solution to Problem

A refrigerator according to an aspect may include a first insulation wall having a first storage space. The refrigerator further include a second insulation wall having second storage space arranged in a first direction together with the first insulation wall. The second insulation wall may be configured to open and close the first storage space.

The second storage space may be maintained at a different temperature from the first storage space.

The refrigerator may include a door configured to be arranged in the first direction together with the second insulation wall and to open and close the second storage space.

The second insulation wall may include an upper wall. The second insulation wall may further include a lower wall spaced apart from the upper wall. The second insulation wall may further include a rear wall connecting the upper wall and the lower wall. The rear wall may open and close the first storage space.

The second insulation wall may be rotated after sliding in a direction parallel to the first direction to open the first storage space.

The refrigerator may further include an outer wall configured to be disposed outside the first insulation wall and the second insulation wall to guide the sliding movement of the second insulation wall.

A part of the outer wall may be installed on the upper wall and the lower wall of the first insulation wall.

Another part of the outer wall may extend from the first insulation wall in the first direction. The other part of the outer wall may be provided with a guide slot for movement of the second insulation wall.

The second insulation wall may include a hinge for rotation. The hinge may be accommodated in the guide slot.

The outer wall may further include a side part positioned on the side of each of the first insulation wall and the second insulation wall.

The side part may cover a boundary between the first insulation wall and the second insulation wall in a state in which the second insulation wall closes the first storage space.

The second insulation wall may include a first opening opened and closed by the door. The second insulation wall may further include a second opening exposed to an outside when the second insulation wall opens the first storage space.

The second opening of the second insulation wall may be covered by the outer wall in a state in which the second insulation wall closes the first storage space.

The second insulation wall may include a first partial wall and a second partial wall divided in a second direction intersecting the first direction.

Each of the first partial wall and the second partial wall may be movable relative to the first insulation wall.

The first partial wall may open and close a part of the first storage space. The second partial wall may open and close another part of the first storage space.

The door may include a first door configured to open and close the first partial wall. The door may further include a second door configured to open and close the second partial wall.

The refrigerator may further include a locking mechanism configured to lock or unlock the door and the second insulation wall. In a state in which the door and the second insulation wall are unlocked, the door may open the second insulation wall. In a state in which the door and the second insulation wall are locked, the second insulation wall may open the first storage space.

The lock mechanism may include a lever provided on the door. The lever may be provided on a handle of the door. The lock mechanism may further include a transmission mechanism connected to the lever to transmit the operation force of the lever. The lock mechanism may further include a fixing mechanism configured to receive the operation force of the lever from the transmission mechanism to fix the door and the second insulation wall.

The first insulation wall may include a machine room which is a space independent from the first storage space. An evaporator and a fan are accommodated in the machine room. The first insulation wall may further include a supply flow path configured to supply the air heat-exchanged with the evaporator toward the second insulation wall.

The second insulation wall may include a cold air flow path communicating with the supply flow path in a state in which the first storage space is closed.

In the supply flow path, a damper may be provided. The damper is operated to open the supply flow path in a state in which the second insulation wall closes the first storage space. The damper is operated to close the supply flow path in a state in which the second insulation wall opens the first storage space.

A refrigerator according to another aspect may include a first insulation wall having a freezing chamber. The refrigerator may further include a second insulation wall having a refrigerating chamber.

The second insulation wall may include one side wall configured to open and close the freezing chamber.

The refrigerator may further include a door configured to open and close the refrigerating chamber.

The second insulation wall may be located in front of the first insulation wall and the rear wall of the second insulation wall may open and close the freezing chamber.

The second insulation wall may include a front opening and a side opening. The door may open and close the front opening. When the second insulation wall opens the first storage space, the side opening of the second insulation wall may be opened.

The refrigerator of may further include an outer wall disposed outside the first insulation wall and the second insulation wall to guide the sliding movement of the second insulation wall.

A refrigerator according to another aspect may include a first insulation wall having a freezing chamber and a front opening configured to access to the freezing chamber. The refrigerator may further include a second insulation wall movable with respect to the first insulation wall and configured to open and close the front opening, and having a refrigerating chamber.

The second insulation wall may rotate after sliding to open the front opening.

The refrigerator may further include a door configured to open and close the refrigerating chamber.

A refrigerator according to another aspect may include a first insulation wall having a refrigerating chamber. The refrigerator may further include a second insulation wall configured to open and close the freezing chamber and including a refrigerating chamber. The second insulation wall may include a first opening and a second opening configured to access to the refrigerating chamber.

The refrigerator may further include a door configured to open and close the first opening.

When the second insulation wall opens the first storage space in a state in which the door closes the first opening, the second opening of the second insulation wall may be opened.

Advantageous Effects of Invention

According to the proposed embodiment, the left and right widths of the first and second storage spaces can be increased, so that food having a long width can be stored in each storage space.

In addition, since each storage space can use both the upper space and the lower space, there is an advantage in that the frequency of bending of the user's waist can be reduced when food with high frequency of use is stored in the upper space.

According to the present embodiment, the distance from the front opening to the rear wall of each storage space is reduced, so that the user can easily store or withdraw food in the storage space.

BRIEF DESCRIPTION OF DRAWINGS

FIG. 1 is a perspective view illustrating a refrigerator according to an embodiment of the present disclosure;

FIG. 2 is a plan view illustrating the refrigerator of FIG. 1;

FIG. 3 is a perspective view illustrating a state in which a door opens a second storage space of a second insulation wall according to an embodiment of the present disclosure;

FIG. 4 is a plan view illustrating the refrigerator of FIG. 3;

FIG. 5 is a block diagram illustrating a locking mechanism of a door and a second insulation wall according to an embodiment of the present disclosure;

FIG. 6 is a perspective view illustrating a state in which a second insulation wall opens a first storage space according to an embodiment of the present disclosure;

FIG. 7 is a plan view illustrating the refrigerator of FIG. 6;

FIG. 8 is an enlarged view illustrating the guide slot of FIG. 7;

FIG. 9 is a cross-sectional view taken along line 9-9 of FIG. 2;

FIG. 10 is a front view illustrating a state in which a door opens a second storage space according to an embodiment of the present disclosure;

FIG. 11 is a control block diagram of a refrigerator according to an embodiment of the present disclosure;

FIG. 12 is a perspective view illustrating a refrigerator according to another embodiment of the present disclosure;

FIG. 13 is a perspective view illustrating a refrigerator according to another embodiment of the present disclosure; and FIG. 14 is a view illustrating a state in which a door opens a second storage space according to another embodiment of the present disclosure.

MODE FOR THE INVENTION

Hereinafter, some embodiments of the present disclosure will be described in detail with reference to exemplary drawings. In adding reference numerals to the components of each drawing, it should be noted that the same components are given the same reference numerals as much as possible even though they are indicated on different drawings. In addition, in describing the embodiment of the present disclosure, if it is determined that a detailed description of a related known configuration or function interferes with the understanding of the embodiment of the present disclosure, the detailed description thereof will be omitted.

In addition, in describing the components of the embodiment of the present disclosure, terms such as first, second, A, B, (a), and (b) may be used. These terms are only for distinguishing the component from other components, and the essence, order, or sequence of the component is not limited by the term. When it is described that a component is "connected", "coupled" or "accessed" to another component, It will be understood that the component may be directly connected or assessed to the other component, but another component may be "connected", "coupled" or "accessed" between each component.

FIG. 1 is a perspective view illustrating a refrigerator according to an embodiment of the present disclosure; and FIG. 2 is a plan view illustrating the refrigerator of FIG. 1.

Referring to FIG. 1 and FIG. 2, the refrigerator 1 according to the present embodiment may include a first insulation wall 10 forming a first storage space 11.

The refrigerator 1 may further include a second insulation wall 20 positioned adjacent to the first insulation wall 10 and forming a second storage space 21. The refrigerator 1 may further include a door 30 for opening and closing the second storage space 21.

The first insulation wall 10 and the second insulation wall 20 may be arranged in a first direction, for example. The first direction may be, for example, a front and rear direction of the refrigerator 1.

The door 30 and the second insulation wall 20 may be arranged in the first direction.

Accordingly, the second insulation wall 20 may be positioned between the door 30 and the first insulation wall 10. In other words, the first insulation wall 10, the second insulation wall 20, and the door 30 may be sequentially arranged in the first direction.

The first insulation wall 10 may be an insulation box with an open front. In other words, the first insulation wall 10 may include a front opening 112.

The second insulation wall 20 may open and close the front opening 112. For example, the second insulation wall 20 may be positioned in front of the first insulation wall 10 to open and close the first storage space 11. In other words, the second insulation wall 20 may move relative to the first insulation wall 10.

The temperature of the first storage space 11 may be different from the temperature of the second storage space 21.

According to the needs of the user, the first storage space 11 may be used as a freezing chamber and the second storage space 21 may be used as a refrigerating chamber, and vice versa.

Since the first storage space 11 can be opened by moving the second insulation wall 20, it may be advantageous in terms of user convenience to store foods with high frequency of use in the second storage space 21.

In a state in which the second insulation wall 20 closes the first storage space 11, the rear wall of the second insulation wall 20 may be in contact with the front surface of the first insulation wall 10.

In order for the second insulation wall 20 to open the first storage space 11, the second insulation wall 20 is moved so that the rear wall of the second insulation wall 20 can be spaced apart from the front of the first insulation wall 10.

A width (as an example, left and right width) of the first insulation wall 10 in a second direction crossing the first direction and horizontally is the same as or similar to the width in the second direction of the second insulation wall 20. In this case, the similar width means that the ratio of the narrow insulation wall to the wide insulation wall is 0.9 or more.

Accordingly, the width in the second direction of the first storage space 11 formed by the first insulation wall 10 may be also the same as or approximately similar to the width of the second storage space 21 formed by the second insulation wall 20 in the second direction.

Due to this shape, the user can store food having a large left and right width in the first storage space 11 or the second storage space 21.

In the present embodiment, the first insulation wall 10 may include an inner case forming a storage space, an outer case surrounding the inner case, and an insulation material provided between the inner case and the outer case.

The second insulation wall 20 may include an inner case forming a storage space, an outer case surrounding the inner case, and an insulation material provided between the inner case and the outer case.

The insulation material may be a vacuum insulation body formed by curing the foamed liquid injected into the space between the inner case and the outer case or inserted into the space between the inner case and the outer case.

The second insulation wall 20 serves as a door for opening and closing the first storage space 11, and since the second insulation wall 20 includes an insulation material, the insulation performance between the first storage space 11 and the second storage space 21 may be maintained.

The door 30 may open and close the second storage space 21 by, for example, a rotation operation.

The door 30 may include a first door 31 and a second door 32 arranged in the second direction. Each of the first door 31 and the second door 32 may be rotatably connected to the second insulation wall 20 by a door hinge 50.

In this case, the rotation directions of the first door 31 and the second door 32 may be opposite to each other. Each of the first door 31 and the second door 32 may include a handle 33 for user to grip. A lever 34 may be provided on the handle 33.

In order to open the first storage space 11, the user may operate the lever 34. If the handle 33 is pulled while the lever 34 is not operated, the door 30 may open the second storage space 21.

On the other hand, when the lever 34 is operated, the door 30 and the second insulation wall 20 may be in a state of being connected to each other (locked state). When the handle 33 is pulled in this state, the door 30 does not rotate, and the second insulation wall 20 connected to the door 30 moves with respect to the first insulation wall 10 to open the first storage space 11. The operation of the lever 34 will be described later.

The refrigerator 1 may further include an outer wall 40 (or guide wall) for guiding the relative movement of the second insulation wall 20 with respect to the first insulation wall 10. The outer wall 40 may be positioned above and below the refrigerator 1. The outer wall 40 may form the outer appearance of the refrigerator 1.

A part of the outer wall 40 may extend in the first direction and be seated on an upper side of the first insulation wall 10 and an upper side of the second insulation wall 20.

Another part of the outer wall 40 may extend in the first direction to support a lower side of the first insulation wall 10 and a lower side of the second insulation wall 20.

For example, the outer wall 40 may include an upper outer wall and a lower outer wall.

One member of the upper outer wall guides the movement of the second insulation wall 20 while having a width equal to or similar to the left and right widths of the refrigerator 1, or in a state in which a plurality of upper outer walls are spaced apart from each other in the second direction, the movement of the second insulation wall 20 may be guided.

The outer wall 40 may cover a boundary between the first insulation wall 10 and the second insulation wall 20. The outer wall 40 may be fixed to the upper side of the first insulation wall 10. The second insulation wall 20 may move relative to the outer wall 40.

FIG. 3 is a perspective view illustrating a state in which a door opens a second storage space of a second insulation wall according to an embodiment of the present disclosure; FIG. 4 is a plan view illustrating the refrigerator of FIG. 3; and FIG. 5 is a block diagram illustrating a locking mechanism of a door and a second insulation wall according to an embodiment of the present disclosure.

FIG. 6 is a perspective view illustrating a state in which a second insulation wall opens a first storage space according to an embodiment of the present disclosure; FIG. 7 is a plan view illustrating the refrigerator of FIG. 6; FIG. 8 is an enlarged view illustrating the guide slot of FIG. 7.

Referring to FIGS. 3 to 8, the second insulation wall 20 may include a first partial wall 20*a* and a second partial wall 20*b* divided in the left and right direction.

The first partial wall 20*a* and the second partial wall 20*b* may be formed to be symmetrical with respect to a vertical plane. The first partial wall 20*a* may open and close a part of the first storage space 11. The second partial wall 20*b* may open and close another part of the first storage space 11.

The first partial wall 20*a* may include a first upper wall 251. The first partial wall 20*a* may further include a first lower wall 252. The first partial wall 20*a* may further include a first rear wall 254 connecting the first upper wall 251 and the first lower wall 252 with each other. The first partial wall 20*a* may further include a first side wall 253 connecting the first upper wall 251 and the first lower wall 252.

Accordingly, the first partial wall 20*a* may include a first front opening 250. The first partial wall 20*a* may further include a first side opening 255.

The second partial wall 20*b* may include a second upper wall 261. The second partial wall 20*b* may further include a second lower wall 262. The second partial wall 20*b* may further include a second rear wall 264 connecting the second upper wall 261 and the second lower wall 262 with each other. The second partial wall 20*b* may further include a second side wall 263 connecting the second upper wall 261 and the second lower wall 262.

Accordingly, the second partial wall 20*b* may include a second front opening 260. The second partial wall 20*b* may further include a second side opening 265.

In the present embodiment, the front openings 250 and 260 may be referred to as first openings, and the side openings 255 and 265 may be referred to as second openings.

In a state in which the second insulation wall 20 closes the first storage space 11, the first and second side walls 253 and 263 are disposed to face each other and form the an outer appearance of the refrigerator 1.

In a state in which the second insulation wall 20 closes the first storage space 11, the first side opening 255 and the second side opening 265 may be aligned. In other words, in a state in which the second insulation wall 20 closes the first storage space 11, the inner space of the first partial wall 20*a* and the inner space of the second partial wall 20*b* may communicate through the first side opening 255 and the second side opening 265.

A gasket may be provided on walls facing each other in the first partial wall 20*a* and the second partial wall 20*b*. For example, the gasket may be provided on at least one of the first partial wall 20*a* and the second partial wall 20*b*.

Each of the partial walls 20*a* and 20*b* may include a plurality of shelves 22 arranged in the vertical direction and for supporting food. The shelf 22 provided on the first partial wall 20*a* may be disposed at the same height as the shelf provided on the second partial wall 20*b*.

The shelf 22 provided on the first partial wall 20*a* may be supported or fixed to at least one of the first rear side wall 254 and the first side wall 253.

The shelf 22 provided on the second partial wall 20*b* may be supported or fixed to at least one of the second rear wall 264 and the second side wall 263.

The first insulation wall 10 may also include a plurality of shelves 12 arranged in the vertical direction. The shelf 12 may be supported or fixed to one or more of side walls and rear walls of both sides of the first insulation wall 10.

The first door 31 may open and close the first front opening 250. The second door 32 may open and close the second front opening 260.

When the first door 31 is rotated while the second insulation wall 20 closes the first storage space 11, only the first front opening 250 may be opened. When the second door 32 is rotated while the second insulation wall 20 closes the first storage space 11, only the second front opening 260 may be opened.

When the first door 31 and the second door 32 are rotated, the entire second storage space 21 may be opened.

When the second insulation wall 20 opens the first storage space 11 while the door 30 is closed, the first side opening 250 of the first partial wall 20*a* and the second side opening 260 of the second partial wall 20*b* may be exposed or open. In this state, the user can access the first storage space 11 as well as the second storage space 21.

When the second insulation wall 20 opens the first storage space 11, the second storage space 21 may be divided into two independent spaces.

The first and second doors 31 and 32 may include a recessed part 31*a* in which a part of a rear part is recessed toward the front. A basket 31*b* for accommodating food may be accommodated and coupled to the recessed part 31*a*. In this case, the basket 31*b* may be disposed to correspond to a space between two adjacent shelves 22 arranged in the vertical direction.

Meanwhile, a lever 34 may be provided on the handle 33 of each of the first door 31 and the second door 32.

A transmission mechanism 35 for transmitting the operation force of the lever 34 may be provided at each of the first door 31 and the second door 32. A part of the delivery mechanism 35 may be located within the handle 33, and another part thereof may be located on each of the doors 31, 32.

The transmission mechanism 35 may include, for example, a plurality of links for transmitting the operation force of the lever 34. At least one of the plurality of links may extend in the vertical direction. A fixing mechanism 36 may be connected to any one of the plurality of links. Alternatively, the fixing mechanism 36 may be in contact with any one of the plurality of links to receive power.

The fixing mechanism 36 may be provided to protrude from the first door 31 and the second door 32. The fixing mechanism 36 protruding from the first door 31 and the second door 32 may be inserted into the second insulation wall 20. A fixing part (not illustrated) for hanging a part of the fixing mechanism 36 may be provided on the second insulation wall 20. Accordingly, the fixing mechanism 36 can selectively fix or release the door 30 and the second insulation wall 20.

In the present embodiment, the lever 34, the delivery mechanism 35, and the fixing mechanism 36 may constitute a locking mechanism for locking between the door 30 and the second insulation wall 20.

For example, when the lever 34 is operated, the door 30 and the second insulation wall 20 may be locked by the locking mechanism. On the other hand, when the operation of the lever 34 is released, the door 30 and the second insulation wall 20 may be unlocked by the lock mechanism.

Accordingly, when the first storage space 11 is to be opened, the user may operate the lever 34.

Of course, on the contrary, when the lever 34 is operated, the door 30 and the second insulation wall 20 may be unlocked by the lock mechanism. On the other hand, when the lever 34 is operated, the door 30 and the second insulation wall 20 may be unlocked by the lock mechanism. In this case, when the second storage space 21 is to be opened, the user may operate the lever 34.

In this case, the lever 34 may be replaced with a switch or a sensor for detecting the user's touch. In this case, the transmission mechanism 35 and the fixing mechanism 36 may be automatically operated by receiving power from a separate motor.

Meanwhile, the outer wall 40 may include a guide slot 41 for guiding the movement of the second insulation wall 20. The guide slot 41 may extend in the first direction.

The thickness of the second insulation wall 20 in the first direction is significantly greater than the thickness of the door 30. The reason is that the second insulation wall 20 must secure a depth for storing food.

In the present embodiment, since the second insulation wall 20 includes the first partial wall 20*a* and the second partial wall 20*b* arranged in the second direction, in a state in which the second insulation wall 20 closes the first storage space 11, the first partial wall 20*a* and the second partial wall 20*b* cannot open the first storage space 11 due to the rotational operation.

Accordingly, in order for the second insulation wall 20 to open the first storage space 11, the second insulation wall 20 may be rotated after being horizontally moved by a predetermined length in the first direction.

For example, a user can access the first storage space 11 by a rotational operation after sliding of the second insulation wall 20 in a linear direction.

In this case, the first storage space 11 may be opened while the second heat insulation wall 20 moves in a direction away from the front surface 111 of the first heat insulation wall 10.

After the second insulation wall 20 is moved a predetermined distance, the distance between the first partial wall 20*a* and the second partial wall 20*b* increase due to the rotation operation of the first partial wall 20*a* and the second partial wall 20*b* so that the user can access the first storage space 11.

The guide slot 41 may be formed as a part of the lower surface of the outer wall 40 is depressed upward. The guide slot 41 may be disposed to face the upper wall of the second insulation wall 20 in a state in which the second insulation wall 20 closes the first storage space 11.

A part of the outer wall 40 may be fixed to the upper wall of the first insulation wall 10, and the other part may extend forward from the first insulation wall 10. The guide slot 41 may be provided at a part of the outer wall 40 that extends forward from the first insulation wall 10.

In the upper walls 251 and 261 of each of the first and second partial walls 20*a* and 20*b*, a hinge 27 is provided to enable rotation of the first and second partial walls 20*a* and 20*b*. The hinge 27 may protrude from the upper walls 251 and 261 of the first and second partial walls 20*a* and 20*b*.

The hinge 27 may be accommodated in the guide slot 41. The hinge 27 may move in the guide slot 41 in the longitudinal direction of the guide slot 41. In other words, the hinge 27 may move along the guide slot 41 while the second insulation wall 20 opens and closes the first storage space 11. Accordingly, the second insulation wall 20 can slide along the outer wall 40.

According to the relative positions of the second insulation wall 20 and the first insulation wall 10, the guide slot 41 may be divided into three areas.

For example, the guide slot 41 may include a first area 41*a* in which the hinge 27 is positioned in a state in which the second insulation wall 20 closes the first storage space 11.

In a state in which the hinge 27 is positioned in the first area 41*a*, the hinge 27 comes into contact with the surface forming the first area 41*a*.

The guide slot 41 may include a second area 41*b* extending in the first direction from the first area 41*a*. A length of the second area 41*b* may be longer than a length of the first area 41*a*. The second area 41*b* guides movement of the hinge 27 in the first direction.

The guide slot 41 may include a third area 41*c* extending from an end part of the second area 41*b* and limiting movement of the hinge 27 in the first direction. In a state in which the hinge 27 is moved to the third area 41*c*, the second insulation wall 20 may be rotated around the hinge 27.

FIG. 9 is a cross-sectional view taken along line 9-9 of FIG. 2; FIG. 10 is a front view illustrating a state in which a door opens a second storage space according to an embodiment of the present disclosure; and FIG. 11 is a control block diagram of a refrigerator according to an embodiment of the present disclosure.

Referring to FIGS. 6 and 9 to 11, as described above, the second insulation wall 20 may close the first storage space 11. The door 30 may close the second storage space 21.

Although not illustrated, a gasket may be provided on the front surface 111 of the first insulation wall 10.

The first insulation wall 10 may further include a machine room 15 partitioned from the first storage space 11. Although not limited, the machine room 15 may be located below the first storage space 11.

The machine room 15 may include an evaporator 120 through which a refrigerant flows, and a fan 130 through which air flows so that the air is exchanged with the evaporator 120.

The first storage space 11 may be provided with a cold air duct 110 for guiding the air heat-exchanged with the evaporator 120 and discharging the guided air to the first storage space 11.

The cold air duct 110 may guide the air heat-exchanged with the evaporator 120 upward.

The first insulation wall 10 may include a supply flow path 170 so that the air heat-exchanged with the evaporator 120 can be supplied to the second storage space 21. The second insulation wall 20 may include a cold air flow path 270.

When the second insulation wall 20 closes the first storage space 11, the supply flow path 170 and the cold air flow path 270 may communicate with each other.

Since the second insulation wall 20 may be located in front of the first insulation wall 10, the cold air flow path 270 may be provided in, for example, the rear walls 254 and 264 of the second insulation wall 20.

The cold air flow path 270 may be provided, for example, on one or more rear walls 254 and 264 of the first partial wall 20*a* and the second partial wall 20*b*. FIG. 10 shows, for example, that the cold air flow path 270 is positioned on the second partial wall 20*b*.

Since the machine room 15 is located below the first storage space 11, the cold air flow path 270 may be located at the lower side part of the rear walls 254 and 264.

A cold air duct 280 for guiding cold air introduced along the cold air flow path 270 and discharging air to the second storage space 21 may be provided in the second storage space 21. The cold air duct 280 may guide cold air upward.

In this case, the cold air duct 280 may be located on a partial wall in which the cold air flow path 270 is provided. Of course, the cold air duct 280 may be provided on each of the first and second partial walls.

A damper 172 may be provided in the supply flow path 170. The damper 172 may open and close the cold air passage of the supply flow path 170. The damper 172 may adjust the opening angle of the cold air passage.

The refrigerator 1 may further include an open detection part 61 for detecting the opening of the first storage space 11. The open detection part 61 may be, for example, a switch provided on the first insulation wall 10.

When the opening of the first storage space 11 is not detected by the open detection part 61, the controller 60 may control the damper 172 so that the damper 172 opens the supply flow path 170.

On the other hand, when the opening of the first storage space 11 is detected by the open detection part 61, the controller 60 can control the damper 172 to close the supply flow path 170.

Of course, the controller 60 may control the damper 172 so that the temperature of the second storage space 21 is maintained at the target temperature independently of the first storage space 11 or is maintained within the target temperature range. For example, the controller 60 may control the damper 172 based on a temperature sensor provided in the second storage space 21.

When the supply flow path 170 is closed by the damper 172 in a state in which the first storage space 11 is opened, It can be prevented that the air heat-exchanged with the evaporator 120 is directly discharged to the outside through the supply flow path 170.

Hereinafter, a process of opening the first storage space and the second storage space will be described.

First, in order to open the second storage space 21, the user may hold the handle 30 and pull the handle 30. Then, the door 30 is rotated by the door hinge 50 to open the front openings 250 and 260 of the second insulation wall 20.

Next, in order to open the first storage space 11, the user operates the lever 34 while holding the handle 30. Then, the door 30 and the second insulation wall 20 are fixed by the fixing mechanism 36. In this state, the user pulls the handle 30.

Then, the second insulation wall 20 slides away from the first storage space 11 by the outer wall 40 to open the first storage space 11.

In a state in which the hinge 27 of the second insulation wall 20 reaches the third area 41*c* of the guide slot 41, the user can rotate the second insulation wall 20. Then, the second insulation wall 20 is rotated to finally expose the first storage space 11 to the front so that the user can access the first storage space 11.

In a state in which the second insulation wall 20 opens the first storage space 11, the side openings 252 and 262 of the second insulation wall 20 are opened, so that the user can also access the second storage space 21 through the side openings 252 and 262.

According to the proposed embodiment, the left and right widths of the first and second storage spaces can be increased, so that food having a long width can be stored in each storage space.

In addition, since each storage space can use both the upper space and the lower space, there is an advantage in that the frequency of bending of the user's waist can be reduced when food with high frequency of use is stored in the upper space.

According to the present embodiment, the distance from the front opening to the rear wall of each storage space is reduced, so that the user can easily store or withdraw food in the storage space.

FIG. 12 is a perspective view illustrating a refrigerator according to another embodiment of the present disclosure.

The present embodiment is the same as the previous embodiment in other parts, except that there is a difference only in the shape of the outer wall. Therefore, only the characteristic parts of the present embodiment will be described below.

Referring to FIG. 12, the refrigerator 1A according to the present embodiment may include a first insulation wall 10, a second insulation wall 20, a door 30, and an outer wall 400.

The outer wall 400 may include an upper part 402 positioned above the refrigerator 1A. The outer wall 400 may further include a lower part 404 positioned below the refrigerator 1A. The outer wall 400 may further include a side part 406 that connects the upper part 402 and the lower part 404 with each other and is positioned on a side surface of the refrigerator 1A.

The outer wall 400 may form a part of the outer appearance of the refrigerator 1A. The upper part 402 and the lower part 404 may include guide slots as in the previous embodiment.

The side part 406 may restrict movement of the second insulation wall 20 in the second direction (left and right direction) while the second insulation wall 20 opens the first storage space 11. In other words, the side part 406 may guide the movement of the second insulation wall 20 in the first direction (front and rear direction).

The side part 406 may cover the boundary between the side wall of the first insulation wall 10 and the side wall of the second insulation wall 20, in a state in which the second insulation wall 20 is in contact with the first insulation wall 10.

When the second insulation wall 20 is rotated in a state in which the second insulation wall 20 is slid forward, the second insulation wall 20 and the side part 406 are prevented from interfering with each other, the front end of the side part 406 may be located behind the front end of the upper part 402 and the front end of the lower part 404. For example, a length of the side part 406 in the first direction may be shorter than a length of the upper part 402 and the lower part 404 in the first direction.

FIG. 13 is a perspective view illustrating a refrigerator according to another embodiment of the present disclosure; and FIG. 14 is a view illustrating a state in which a door opens a second storage space according to another embodiment of the present disclosure.

The present embodiment is the same as the previous embodiments in other parts, except that the second insulation wall 20 forms one independent second storage space and the second storage space is opened and closed by one door. Therefore, only the characteristic parts of the present embodiment will be described below.

Referring to FIGS. 13 and 14, the refrigerator 1C of the present embodiment may include a door 700 for opening and closing the first insulation wall 10, the second insulation wall 600, a door 700 for opening and closing the second insulation wall 600, and an outer wall.

The first insulation wall 10 may form a first storage space (refer to 11 of FIG. 6) that is an independent space. The second insulation wall 600 may form a second storage space 601 that is an independent space. The door 700 may open and close the second storage space 601 as a single door.

The second insulation wall 600 may be formed in the same shape but different in size from the second partial wall 20*b* described with reference to FIG. 6. In other words, the second insulation wall 600 may include an upper wall, a lower wall, one side wall, and a rear wall. Accordingly, the second insulation wall 600 may include a front opening 602 and a side opening 604.

The front opening 602 may be opened and closed by the door 700. The side opening 604 may be exposed to the outside when the second insulation wall 600 opens the first storage space.

A door hinge 610 may be connected to the second insulation wall 600 at a position adjacent to the one side wall. In the door 700, a handle 710 may be provided opposite to a part to which the door hinge 610 is connected.

The outer wall may include a first outer wall 500. The outer wall may include a second outer wall 510. For example, the first outer wall 500 may cover the right side of the refrigerator 1C, and the second outer wall 510 may cover the left side of the refrigerator 1C.

The first outer wall 500 and the second outer wall 510 may have the same structure and function as the outer wall 400 described with reference to FIG. 12.

In the present embodiment, the second outer wall 510 serves to additionally cover the side opening 604 of the second insulation wall 600 in a state in which the second insulation wall 20 closes the first storage space.

Accordingly, a gasket may be provided around the side opening 604 of the second insulation wall 600.

The second outer wall 510 may include an insulation material so that the insulation performance is maintained while the second outer wall 510 closes the side opening 604 of the second insulation wall 600. In order to reduce the thickness of the second outer wall 510, the second outer wall 510 may include a vacuum insulation material.

The invention claimed is:

1. A refrigerator comprising:

a first insulation wall having a first storage space;

a second insulation wall configured to be arranged in a first direction together with the first insulation wall and having a second storage space maintained at a different temperature from the first storage space, and configured to open and close the first storage space; and a door configured to be arranged in the first direction together with the second insulation wall and to open and close the second storage space, wherein the second insulation wall includes an upper wall, a lower wall, and a rear wall connecting the upper wall and the lower wall, wherein the rear wall opens and closes the first storage space, and wherein the second insulation wall is rotated after sliding in a direction parallel to the first direction to open the first storage space.

2. The refrigerator of claim 1, further comprising:

an outer wall configured to be disposed outside the first insulation wall and the second insulation wall to guide the sliding movement of the second insulation wall.

3. The refrigerator of claim 2, wherein a part of the outer wall is installed on the upper wall and the lower wall of the first insulation wall, wherein other part of the outer wall extends from the first insulation wall in the first direction, and wherein the other part of the outer wall is provided with a guide slot for movement of the second insulation wall.

4. The refrigerator of claim 3, wherein the second insulation wall includes a hinge for rotation, and wherein the hinge is accommodated in the guide slot.

5. The refrigerator of claim 2, wherein the outer wall further includes a side part positioned on the side of each of the first insulation wall and the second insulation wall, and wherein the side part covers a boundary between the first insulation wall and the second insulation wall in a state in which the second insulation wall closes the first storage space.

6. The refrigerator of claim 2, wherein the second insulation wall includes a first opening opened and closed by the door and a second opening exposed to an outside when the second insulation wall opens the first storage space.

7. The refrigerator of claim 6, wherein the second opening of the second insulation wall is covered by the outer wall in a state in which the second insulation wall closes the first storage space.

8. The refrigerator of claim 1, wherein the second insulation wall includes a first partial wall and a second partial wall divided in a second direction intersecting the first direction, wherein each of the first partial wall and the second partial wall is movable relative to the first insulation wall, and wherein the first partial wall opens and closes a part of the first storage space and the second partial wall opens and closes another part of the first storage space.

9. The refrigerator of claim 8, wherein the door includes a first door configured to open and close the first partial wall and a second door configured to open and close the second partial wall.

10. The refrigerator of claim 1, further comprising:

a locking mechanism configured to lock or unlock the door and the second insulation wall, wherein, in a state in which the door and the second insulation wall are unlocked, the door opens the second insulation wall, and wherein, in a state in which the door and the second insulation wall are locked, the second insulation wall opens the first storage space.

11. The refrigerator of claim 10, wherein the lock mechanism includes a lever provided on the door;

a transmission mechanism connected to the lever to transmit the operation force of the lever; and a fixing mechanism configured to receive the operation force of the lever from the transmission mechanism to fix the door and the second insulation wall.

12. The refrigerator of claim 1, wherein the first insulation wall includes a machine room which is a space independent from the first storage space, an evaporator and a fan accommodated in the machine room, and a supply flow path configured to supply the air heat-exchanged with the evaporator toward the second insulation wall, wherein the second insulation wall includes a cold air flow path communicating with the supply flow path in a state in which the first storage space is closed.

13. The refrigerator of claim 12, wherein, in the supply flow path, a damper operated to open the supply flow path in a state in which the second thermal insulation wall closes the first storage space, and to close the supply flow path in a state in which the second insulation wall opens the first storage space.

14. A refrigerator comprising:

a first insulation wall having a freezing chamber and a front opening configured to access to the freezing chamber; and a second insulation wall movable with respect to the first insulation wall and configured to open and close the front opening, and having a refrigerating chamber;

wherein the second insulation wall rotates after sliding to open the front opening.

15. The refrigerator of claim 14, further comprising a door configured to open and close the refrigerating chamber.

16. A refrigerator comprising:

a first insulation wall having a first storage space and having a first upper wall and a first lower wall;

a second insulation wall configured to be arranged in a first direction together with the first insulation wall and having a second storage space maintained at a different temperature from the first storage space, configured to open and close the first storage space, and having a second upper wall and a second lower wall;

a door configured to be arranged in the first direction together with the second insulation wall and to open and close the second storage space;

at least one upper guide plate provided on the first upper wall and the second upper wall, the at least one upper guide plate extending from a rear of the first insulation wall toward a front of the second insulation wall such that the at least one upper guide plate crosses a boundary between the first insulation wall and the second insulation wall in a state in which the second insulation wall closes the first storage space;

an upper guide slot provided on a portion the at least one upper guide plate on the second upper wall such the upper guide slot remains in front of the boundary;

at least one lower guide plate provided on the first lower wall and the second lower wall, the at least one lower guide plate extending from the rear of the first insulation wall toward the front of the second insulation wall such that the at least one lower guide plate crosses the boundary; and a lower guide slot provided on a portion the at least one lower guide plate on the second lower wall such the lower guide slot remain in front of the boundary.

* * * * *